United States Patent [19]

Rollor, Jr. et al.

[11] 4,077,122

[45] Mar. 7, 1978

[54] HAIR CUTTING AND TRIMMING APPARATUS

[76] Inventors: Edward A. Rollor, Jr., 658 Wisteria Dr.; Clarence H. Hunt, 591 Hillandal Cir., both of Marietta, Ga. 30064

[21] Appl. No.: 767,983

[22] Filed: Feb. 11, 1977

[51] Int. Cl.[2] ..... B26B 19/20; B26B 19/44

[52] U.S. Cl. ..... 30/133; 30/41.5

[58] Field of Search ..... 30/133, 41.5, 90, 1, 30/131; 132/45 R, 45 A; 83/22, 24

[56] References Cited

U.S. PATENT DOCUMENTS

| | | | |
|---|---|---|---|
| 2,523,201 | 9/1950 | Ellis | 30/133 |
| 3,073,026 | 1/1963 | Schaedler | 30/133 |
| 4,000,562 | 1/1977 | Alevras | 30/133 |

*Primary Examiner*—Robert C. Watson
*Attorney, Agent, or Firm*—Rose & Edell

[57] ABSTRACT

A hair cutting and trimming apparatus includes an elongated hollow tube atop which is a hollow head member having a width which is considerably larger than its height. The hollow interiors of the tube and head are in flow communication so that suction applied to the bottom of the tube draws air into the open forward end of the head. Mounting means are provided on the outside of the tube for an electric clipper positioned so that its teeth extend into the head through a suitably provided slit opening in the under side of the head. The longitudinal axis of the tube and the length dimension of the head form an angle in the range of 90° to 120° to permit a user to hold the open forward end of the head adjacent a scalp without having to raise the user's elbow and arm to an uncomfortable position. A plurality of extenders of different length are adapted to fit under the forward end of the head member to permit selective adjustment of the length of hair cut by the clipper teeth.

11 Claims, 10 Drawing Figures

FIG.6
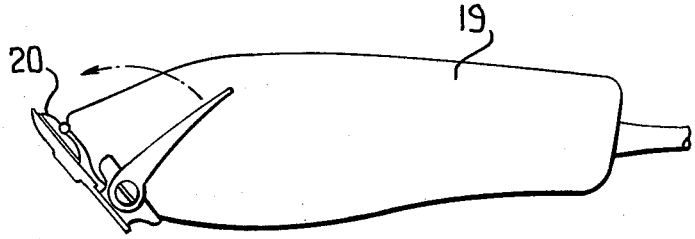
FIG.7
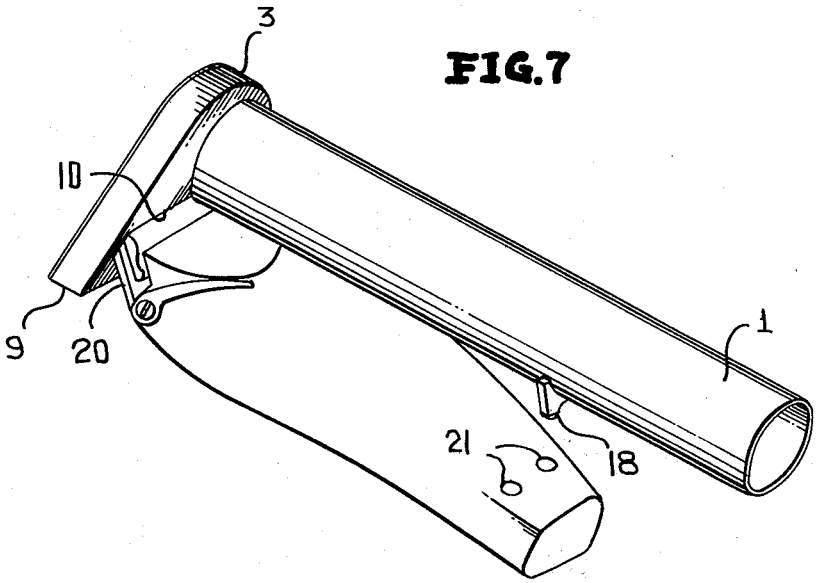
FIG.8
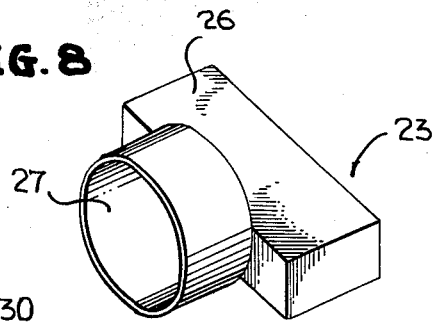
FIG.9
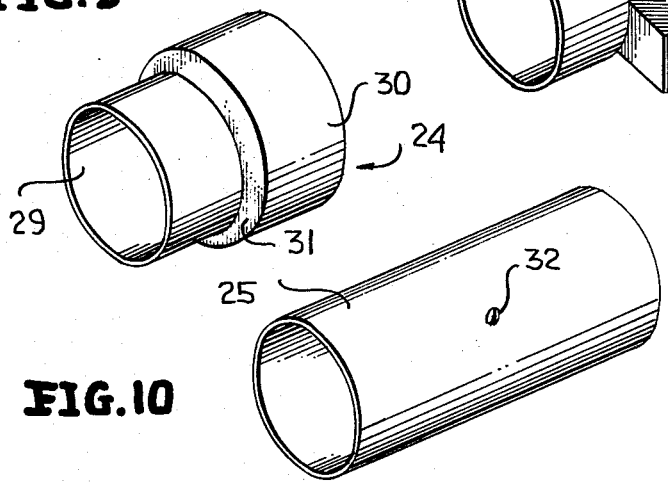
FIG.10

HAIR CUTTING AND TRIMMING APPARATUS

BACKGROUND OF THE INVENTION

The present invention relates to hair cutting and trimming devices in which a length of hair is suctioned into a hollow body and cut therein. More particularly, the present invention relates to improvements in such devices which provide greater versatility, simpler hair length selection, and more convenience in use than is permitted by prior art devices.

It is known in the prior art to use a vacuum source in conjunction with an automatic hair cutting and trimming device. Such prior art may be readily separated into two categories: those in which the vacuum is used only to remove hair clippings from the cutter (as typified by U.S. Pat. Nos. 1,618,713; 2,653,380; and 2,748,472); and those in which the vacuum is also used to stretch out the hair so that it may be cut to a particular length (as typified by U.S. Pat. Nos. 1,238,061; 1,331,218; 1,735,766; 3,654,699; and 3,979,825). The present invention is concerned with the second type of device wherein the vacuum source serves the combined function of removing the clippings and extending the hair. Such devices in the prior art have the clipper located entirely inside the suction path, a feature which makes for many practical disadvantages. For example, the portion of the suction device which is placed against the scalp must be relatively long to accommodate the cutter and therefore requires the user's arms to be held in uncomfortable positions. Further, with the cutter mounted inside the suction device it becomes difficult, if not impossible, to use the cutter independently of the suction device.

It is also important in devices of this type to include gauging means for selectively changing the length of hair to be cut. Such gauging means in the prior art have taken forms such as: a sleeve which threadedly engages the forward end of the device (as in U.S. Pat. No. 1,238,061); a sleeve which slidably engages the forward end of the device (as in U.S. Pat. No. 3,654,699); and means for moving the clipper itself within the body of the device (U.S. Pat. No. 3,979,825). All of these gauging approaches provide for continuous adjustment mechanisms (as opposed to discrete length settings) and are complex to operate and expensive to mass produce.

It is an object of the present invention to provide a hair cutting device which permits hair to be cut to a preselected length by an unskilled person.

It is a further object of this invention to provide for the use of a vacuum means to pull individual hairs into straight line configurations along the length of a gauge which sets the cutting length without requiring the entire clipper set to be inside the walls of the air passage.

It is still a further object of the invention to provide a simple means to change hair cutting length over a wide range without complicating the design and manufacture of the device.

It is a still further object of the invention to provide a hair cutting and gauging device which is neither awkward nor inconvenient for the user to hold and operate.

SUMMARY OF THE INVENTION

In accordance with the present invention, a vacuum attachment includes a hollow head portion secured in flow communication to one end of a hollow tube, the tube in turn having its other end connected to a vacuum source. The height of the head portion is much smaller than the width and is arranged such that hair is drawn into its open forward end. The angle made by the tube and the under surface of the head portion is in the range of approximately 90° to 120° so that a user can hold the tube in one hand and place the forward end of the head portion against a scalp while keeping the user's arm in comfortable positions. Mounting means are provided on the tube exterior for an electric clipper to be positioned with its cutter blades extending into the head portion through a slot defined in the head undersurfaces. Attachments of specific axial length are adapted to functionally engage the forward end of the head portion to selectively shorten the length of hair extending to the cutter blades.

BRIEF DESCRIPTION OF THE DRAWINGS

FIG. 6 is a side view in plan of a conventional electrical hair clipper;

FIG. 7 is a view in perspective of the hair clipper of FIG. 6 being mounted onto the device of FIG. 1;

FIG. 8 is a view in perspective of an adapter which fits over the forward end of the head portion of the device of FIG. 1; and FIGS. 9 and 10 are views in perspective of two gauge members which are adapted to fit into the forward end of the adapter of FIG. 8.

DESCRIPTION OF THE PREFERRED EMBODIMENT

Figure 1:
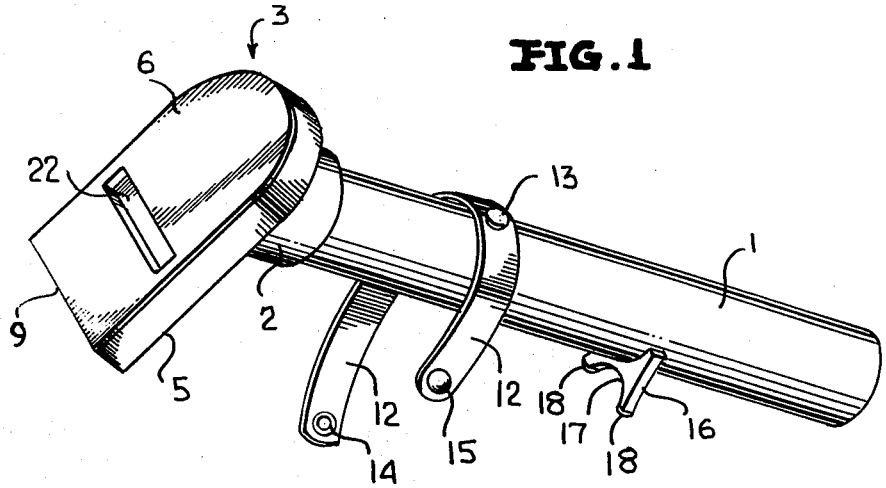
FIG. 1 is a view in perspective of the major component of the preferred embodiment of the present invention.
Figure 2:
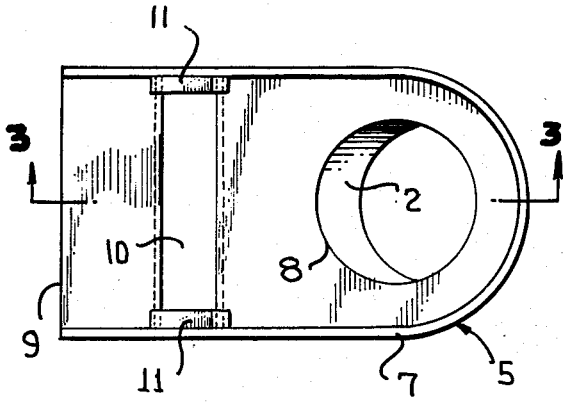
FIG. 2 is a top view in plan of the head portion of the device of FIG. 1 without its cap.
Figure 4:
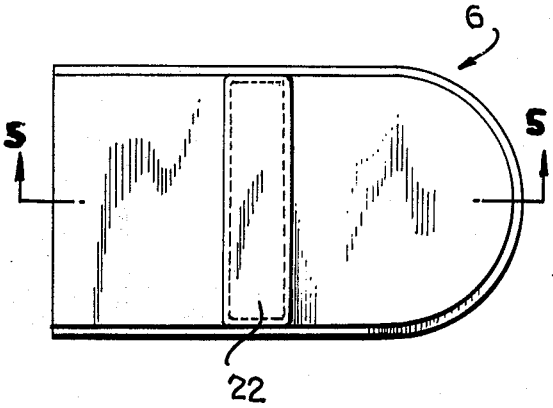
FIG. 4 is a bottom view in plan of the cap for the head portion of the device of FIG. 1.
Figure 3:
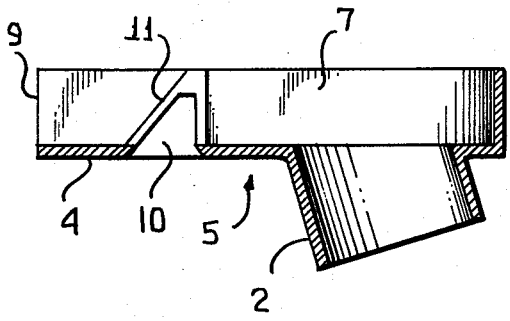
FIG. 3 is a view in section taken along lines 3 — 3 of FIG. 2.
Figure 5:
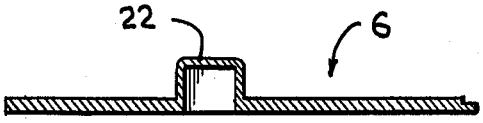
FIG. 5 is a view in section taken along lines 5 — 5 of FIG. 4.

Referring specifically to FIGS. 1 - 5, the major component of the present invention is illustrated as a plurality of individually molded parts which are bonded together. It is to be understood that a single part may be so molded to take the shape and perform the functions described herein. A hollow cylindrical tube 1 has a lower end adapted to be connected to a hose or other inlet connection for a vacuum source, such as a standard household vacuum cleaner. The upper end of tube 1 is inserted into and secured to a neck 2 which depends from the under side 4 of a head member 3. The head member comprises: a body portion 5 which is open along its top and from which neck 2 depends; and a cap 6 which covers the open top of the body portion. Body portion 5 has a bottom wall, formed by under side 4, of a generally solid U-shape and is bounded along its periphery by an upstanding U-shaped wall 7. A hole 8 is defined through wall 4, proximate the back end of head 3, from which hollow neck 2 projects downwardly at an angle between 90° and 120°. This angle defines the angle subsisting between tube 1 and head 3. Cap 6 is also configured in a generally solid U-shape and secured, by suitable adhesive or the like, to the top edge of upstanding wall 7. A recess 22 is defined transversely across cap 6 and projects part way down toward bottom wall 4 at a location forward of hole 8. The forward end of the head is open to form a rectangular slot 9.

A transversely extending rectangular slot 10 is defined in bottom wall 4. A pair of generally inverted V-shaped guard members 11 are formed in wall 7 at opposite ends of slot 10 and extend from top to bottom of head 3.

A strap 12 is secured to tube 1 by means of a rivet 13 or the like so as to extend circumferentially about tube 1 with considerable slack. Specifically, the slack in strap 12 is selected to permit the strap to hold the body of an electric hair clipper against the tube 1. Engagement means, such as mating snap-fit members 14 and 15, are provided at opposite ends of the strap to securely hold the clipper in position. A cradle 16 is secured to tube 1, at a location below strap 12 and includes a generally arcuate support surface 17 terminating in two projecting feet 18.

The unit as described thus far is arranged to support an electric clipper 19, such as that illustrated in FIG. 6. The particular clipper 19 so illustrated is the commercially available Model 23-01B manufactured by the John Oster Manufacturing Company of Milwaukee, Wis. It is to be understood that the present invention can be constructed to accommodate other types of clippers equally as well.

As best illustrated in FIG. 7, clipper 19 is secured to the device of the present invention by first inserting the clipper blades 20 into slot 10. When the blades are fully inserted in the slot, feet 18 of cradle 16 are positioned to extend into recessed screw holes 21 of clipper 19. Likewise, the body of the clipper rests in the arcuate surface 17 of the cradle. The strap 12 (shown in FIG. 1 but not in FIG. 7 for purposes of clarity) is then secured about the clipper. The clipper 19 is thus held securely in place, with feet 18 preventing inadvertent movement in any direction.

In operation, the user connects the vacuum source to the lower end of tube 1 and points the slot toward the scalp of the person whose hair is to be cut. The hair is sucked into slot 9, over the blades 20 of clipper 19, and then under the recess 22 which forms an air baffle with the head 3. The baffle acts to pull the elongated hair downward onto the blades 20 to assure that the hair is cleanly and evenly cut. The cut hair is then drawn through hole 8 and tube 1 to the vacuum source.

Slot 9 is located a predetermined distance in front of slot 10 so that the hair can be cut to a length corresponding to that distance. Nominally such distance will be about one inch. Naturally, it is desirable to be able to cut hair to different lengths and, in accordance with this invention an adapter 23 (FIG. 8) and extenders 24 (FIG. 9) and 25 (FIG. 10) are provided for this purpose. Specifically, adapter 23 is a hollow body formed in two sections: a rectangular sleeve 26 at one end; and a cylinder 27 at the other end. Sleeve 26 is adapted to fit over and functionally engage the forward end of head 3 so that slot 9 in head 3 abuts the rear end of cylinder 27. Cylinder 27 thereby serves as an extender, permitting hair to be cut to a length corresponding to the sum of the length of cylinder 27 plus the distance between slots 9 and 10. Extender 24 is in the form of a cylinder having a relatively small diameter section 29 and a relatively large diameter section 30, the transition between the two sections being demarked by an annular shoulder 31. Small-diameter section 29 is configured to fit inside cylinder 27 in abutting relationship to sleeve 26. Extender 24 thereby extends the length to which hair is cut by the length of large-diameter cylinder 30. The diameter of cylinder 30 is the same as that of cylinder 27.

Extender 25 is a simple hollow single cylinder of such diameter to fit into either cylinder 27 or cylinder 30. When placed into cylinder 27 extender 25 abuts sleeve 26 and adds to the length to which the hair is cut. When extender 25 is placed in cylinder 30 it projects only part way therein and combines with extender 24 to increase the hair length. Extender 25 is provided with at least one small hole 32 to permit some air leakage and thereby prevent the applied suction force from grabbing the scalp of the person whose hair is being cut. A variety of extender lengths may be used, each permitting hair to be cut to different predetermined lengths when used along and in combination.

Strap 12 is preferably made of flexible material to permit firm engagement of clipper 19 against tube 1. However, if the strap is properly sized for use with a particular clipper, flexibility is not required of the strap.

The angle formed between tube 1 and head 3 permits the device to be used without the user's arm being held in awkward positions. Specifically, the user holds the device along tube 1 and directs slot 9 of head 3 against the scalp of the person whose hair is being cut. For virtually all scalp locations the user can hold head 3 in place without lifting his elbow up awkwardly and holding it there in a tiring position.

The device of FIG. 1 is preferably made of plastic. Tube 1 is easily extruded whereas head 3 and cap 6 are readily injection molded. As discussed briefly above, the entire device of FIG. 1 may be formed of an integral plastic member having a more gradual bend between the tube and head sections, and having the same advantages as the embodiment described above.

While we have described and illustrated one specific embodiment of our invention, it will be clear that variations of the details of construction which are specifically illustrated and described may be resorted to without departing from the true spirit and scope of the invention as defined in the appended claims.

We claim:

1. Apparatus for use in cutting and trimming hair comprising a body member having a hollow handle portion and a hollow head member having a slotted inflow opening, said head member extending from said handle portion at an angle in the range of 90° to 120°, the hollow interiors of said handle portion and said head member being in flow communication, said handle being adapted to connect to a source of vacuum to draw air into said slotted inflow opening through said head member and handle portion, said head member having a cutting opening defined therein to permit hair which is drawn into said inflow opening to be cut at said cutting opening by cutter blades inserted into said cutting opening from a cutter located outside said apparatus, said apparatus further comprising: baffle means, located slightly downstream of said cutting opening, for forcing said hair transversely toward said cutting opening; and means for securing an electric clipper to said apparatus with the blades of said clipper extending into said head member through said cutter opening.

2. The apparatus according to claim 1 further comprising a plurality of attachments adapted to be secured, both individually and in combination, to said head member over said inflow opening to effectively reduce the length of hair drawn into said inflow opening and thereby increase the length to which the inflowing hair can be cut.

3. Apparatus for use in cutting and trimming hair comprising a body member having a hollow handle portion and a hollow head member having a slotted inflow opening, said head member extending from said handle portion at an angle in the range of 90° to 120°, the hollow interiors of said handle portion and said head member being in flow communication, said handle being adapted to connect to a source of vaccuum to draw air into said slotted inflow opening through said head member and handle portion, said head member having a cutting opening defined therein to permit hair which is drawn into said inflow opening to be cut at said opening by cutter blades inserted into said cutter opening from a cutter located outside said apparatus, and a plurality of attachments adapted to be secured, both individually and in combination, to said head member over said inflow opening to effectively reduce the length of hair drawn into said inflow opening and thereby increase the length to which the inflowing hair can be cut.

4. Apparatus for cutting hair comprising, in combination:

a hollow body member having an inflow opening at one end and means adapted to connect to a vacuum source at another end, said inflow opening being adapted to permit hair from a person's scalp to be sucked therethrough to extend into said body member;

an electric hair clipper having cutter blades;

a cutting slot defined in said body member; and means for securing said hair clipper to the outside of said body member in a position with said cutting blades extending into said cutting slot.

5. The apparatus according to claim 4 further comprising a plurality of attachments adapted to be secured, both individually and in combination, to said body member over said inflow opening to effectively reduce the length of hair drawn into said inflow opening.

6. The apparatus according to claim 4 wherein said body member has a head portion at said another end and a tubular handle at said one end, said tubular handle forming an angle of between 90° and 120° with said head portion.

7. Hair-cutting apparatus, comprising:

conduit means having an outflow opening adapted to be connected to a negative pressure source and an inflow opening adapted to permit air and hair to be drawn therethrough into said conduit means under the influence of said negative pressure source, said conduit means having a cutting opening defined therein at a location past which hair of a prescribed length is extended under the influence of said negative pressure source;

electric hair clipper means secured to the outside of said conduit means, said hair clipper means including cutting blades extending through said cutting opening in position to cut hair extended past said cutting opening in said conduit means.

8. The apparatus according to claim 7 wherein said hair clipper means is removably secured to said conduit means.

9. The apparatus according to claim 7 further comprising a plurality of attachments, each being hollow and open at both ends, adapted to be secured both individually and in combination to said body member over said inflow opening to effectively extend the length of said conduit means and to extend the distance between said cutting opening and the point of entry of hair into said conduit means.

10. The apparatus according to claim 7 further comprising baffle means, disposed inside said conduit means slightly downstream of said slot, for guiding hair generally transversely of air flow direction and toward said cutting opening.

11. Apparatus for use in cutting and trimming hair comprising conduit means having an outflow opening adapted to be connected to a negative pressure source and an inflow opening adapted to permit air and hair to be drawn therethrough into said conduit means under the influence of said negative pressure source, said conduit means having a cutter opening defined therein at a location past which hair of a prescribed length is extended under the influence of said negative pressure source, and means for securing an electric clipper to said conduit means in a position such that blades of the electric clipper extend through said cutting opening in the path of the extended hair.

* * * * *